US012442118B2

(12) United States Patent
Buhler et al.

(10) Patent No.: US 12,442,118 B2
(45) Date of Patent: Oct. 14, 2025

(54) CUTTING DEVICE AND METHOD FOR SEVERING NON-WOVEN-IN SECTIONS OF THREADS OR FILAMENTS WOVEN IN TEXTILE RIBBONS

(71) Applicant: TEXTRACE AG, Frick (CH)

(72) Inventors: Stephan Buhler, Buchs (CH); Dirk Boltersdorf, Kreuzau (DE)

(73) Assignee: Avery Dennison Retail Information Services LLC, Mentor, OH (US)

( * ) Notice: Subject to any disclaimer, the term of this patent is extended or adjusted under 35 U.S.C. 154(b) by 302 days.

(21) Appl. No.: 18/021,925

(22) PCT Filed: Sep. 29, 2020

(86) PCT No.: PCT/EP2020/077188
§ 371 (c)(1),
(2) Date: Feb. 17, 2023

(87) PCT Pub. No.: WO2022/069015
PCT Pub. Date: Apr. 7, 2022

(65) Prior Publication Data

US 2023/0304208 A1 Sep. 28, 2023

(51) Int. Cl.
*D06C 13/06* (2006.01)
*D06H 7/02* (2006.01)
*D06H 7/14* (2006.01)

(52) U.S. Cl.
CPC ..... *D06C 13/06* (2013.01); *D06H 7/02* (2013.01); *D06H 7/14* (2013.01)

(58) Field of Classification Search
CPC ..... D06C 13/06; D06H 7/02; D06H 7/14
See application file for complete search history.

(56) References Cited

U.S. PATENT DOCUMENTS 1,002,415 A * 9/1911 Marbel ..... D06C 13/04 26/11
1,752,611 A * 4/1930 Naumann ..... D06C 13/06 26/11

(Continued)

FOREIGN PATENT DOCUMENTS

CN 108085913 5/2018
CN 208440899 U 1/2019

(Continued)

OTHER PUBLICATIONS

International Search Report and Written Opinion dated Jun. 16, 2021 Issued in corresponding IA No. PCT/EP2020/077188 filed Sep. 29, 2020.

(Continued)

*Primary Examiner* — Omar Flores Sanchez

(57) ABSTRACT

A cutting device includes a ribbon conveying table configured to convey a textile ribbon having a metallized thread or filament quasi-endlessly woven/non-woven in the fabric of the ribbon; at least two cutting assemblies spaced apart from one another along the conveying direction of the textile ribbon, the at least two cutting assemblies being configured to simultaneously perform a cutting action for severing a non-woven-in section of the metallized thread or filament from the fabric of the ribbon and at least two sliding spacers spaced apart from one another along the conveying direction of the textile ribbon, the at least two sliding spacers each being connected to a respective one of the at least two cutting assemblies, contacting the surface of the ribbon and being configured to slidingly move between the metallized thread or filament and the fabric of the ribbon at the edges of the non-woven-in sections to facilitate the cutting action of the at least two cutting assemblies.

18 Claims, 7 Drawing Sheets

(56) References Cited

U.S. PATENT DOCUMENTS

| | | | | |
|---|---|---|---|---|
| 2,594,918 | A * | 4/1952 | Hadley | D06C 13/06 26/10.4 |
| 3,772,127 | A * | 11/1973 | James | D06C 13/06 156/515 |
| 5,406,872 | A * | 4/1995 | Conley, Jr. | D06H 7/02 83/636 |
| 2007/0251207 | A1 | 11/2007 | Stobbe | |
| 2013/0186505 | A1* | 7/2013 | Cross | D03J 1/00 139/11 |
| 2018/0112352 | A1* | 4/2018 | Giachetti | B65H 45/103 |
| 2023/0304214 | A1* | 9/2023 | Cen | D04B 1/16 |

FOREIGN PATENT DOCUMENTS

| | | |
|---|---|---|
| CN | 109338651 | 2/2019 |
| DE | 102011106648 | 1/2013 |
| FR | 1282181 | 1/1962 |
| JP | 5-269890 | 10/1993 |
| KR | 2012-0111427 | 10/2012 |
| WO | 2005/071605 | 8/2005 |
| WO | 2017/216817 | 12/2017 |

OTHER PUBLICATIONS

International Preliminary Report on Patentability dated Mar. 28, 2023 issued in corresponding IA No. PCT/EP2020/077188 filed Sep. 29, 2020.

* cited by examiner

CUTTING DEVICE AND METHOD FOR SEVERING NON-WOVEN-IN SECTIONS OF THREADS OR FILAMENTS WOVEN IN TEXTILE RIBBONS

CROSS-REFERENCE TO RELATED APPLICATIONS

The present application is a 371 of International Application No. PCT/EP2020/077188, which was published in English on Apr. 7, 2022, which is incorporated herein by reference in its entirety.

FIELD OF THE INVENTION

The invention relates to a cutting device for severing non-woven-in sections of threads or filaments woven in textile ribbons. The invention is furthermore concerned with methods for severing non-woven-in sections of threads or filaments woven in textile ribbons.

BACKGROUND OF THE INVENTION

In textile industry, labels are used to identify clothes or other textile goods. Therefore, the labels are integrated into the clothes, for example, at a standardized position. Usually a batch number, the producer name and some further information about the product are printed onto the label and can be analogously written by persons. Since clothes or other textile goods are mostly mass products, they are produced in high automated series production.

In modern high automated systems, radio-frequency identification (RFID) enables the producers and retailers to digitally process and/or keep track of the textile goods. Tiny antenna filaments woven in the labels are able to communicate why a radiofrequency. Thereby it is a problem, that the labels including the antenna filament are stored as a quasi-endlessly textile ribbon rolled around our band reel. Thus, each label is cut from the quasi-endless textile ribbon with the quasi-endless antenna filament woven therein before integrated into the clothes. A loose end of the antenna filament is thereby generated at each label which may negatively impact the sensitive RFID functionality. No solution is present in the prior art, that provides a sufficient severing of the labels and the antenna filament from the quasi-endlessly textile ribbon.

The document WO 2005/071605 A2 discloses for example a textile material that comprises a high-frequency transponder which includes a circuit module and the antenna linked therewith and set to a working frequency. The document DE 10 2011 106 648 A1 discloses a portable data device which consists of an apparatus for storing and processing data, and an antenna for transmitting energy and data, which is connected to the apparatus.

BRIEF SUMMARY OF THE INVENTION

Aspects of the invention may provide solutions for severing non-woven-in sections of metallized threads or filaments, that are alternately woven/non-woven in the fabric of quasi-endlessly textile ribbons.

According to first aspect of the invention, a cutting device for severing non-woven-in sections of threads or filaments woven in textile ribbons comprises: a ribbon conveying table configured to convey a textile ribbon having a metallized thread or filament quasi-endlessly woven/non-woven in the fabric of the ribbon; at least two cutting assemblies spaced apart from one another along the conveying direction of the textile ribbon, the at least two cutting assemblies being configured to simultaneously perform a cutting action for severing a non-woven-in section of the metallized thread or filament from the fabric of the ribbon; and at least two sliding spacers spaced apart from one another along the conveying direction of the textile ribbon, the at least two sliding spacers each being connected to a respective one of the at least two cutting assemblies, contacting the surface of the ribbon and being configured to slidingly move between the metallized thread or filament and the fabric of the ribbon at the edges of the non-woven-in sections to facilitate the cutting action of the at least two cutting assemblies.

According to a second aspect of the invention, a method for severing non-woven-in sections of threads or filaments woven in textile ribbons comprises the steps of: providing a cutting device, in particular a cutting device according to any of the preceding claims, and a textile ribbon having a metallized thread or filament quasi-endlessly woven/non-woven in the fabric of the ribbon; conveying the textile ribbon in the ribbon conveying table in the conveying direction; stopping the ribbon after conveying the ribbon a calculated amount of travel; traveling the cutting assemblies and the sliding spacers from a first position to a second position, wherein the sliding spacers slide between the metallized thread or filament and the fabric of the ribbon at the edges of the non-woven-in section causing the metallized thread or filament to lift away from the fabric; and simultaneously performing a cutting action for severing a non-woven-in section of the metallized thread or filament from the fabric of the ribbon at the edges of the non-woven-in section.

According to a third aspect of the invention, a cutting device for severing non-woven-in sections of fibers woven in fabric straps comprises: a strap conveying table configured to convey a fabric strap with an electrical conductive fiber quasi-endlessly woven/non-woven in the fabric strap; and at least two tool holding structures each having a scissor assembly and a fiber separator, wherein the tool holding structures are movably connected to the strap conveying table; wherein the scissor assemblies of the at least two tool holding structures are arranged parallel to the conveying direction of the fabric strap and configured to simultaneously perform a severing action for severing a non-woven-in section of the electrical conductive fiber from the fabric strap; wherein the fiber separators are configured to slidingly separate the electrical conductive fiber from the fabric strap at the edges of the non-woven-in sections to facilitate the severing action of the scissor assemblies.

According to a fourth aspect of the invention, a method for severing non-woven-in sections of fibers woven in fabric straps comprises the steps of: providing a cutting device, in particular a cutting device of claim 1, and a fabric strap with an electrical conductive fiber quasi-endlessly woven/non-woven in the fabric strap; conveying the fabric strap in the strap conveying table in a conveying direction; stopping the fabric strap after conveying the fabric strap a calculated amount of travel; traveling the tool holding structures from a first position to a second position, wherein the fiber separators slide between the electrical conductive fiber and the fabric strap at the edges of the non-woven-in section causing the electrical conductive fiber to separate from the fabric strap; and simultaneously performing a severing action for severing a non-woven-in section of the electrical conductive fiber from the fabric strap at the edges of the non-woven-in section.

A fundamental concept of the invention is to simultaneously cut a metallized thread or filament, such as an antenna filament, at the edges of a non-woven-in section of the metallized thread or filament. Since the ribbon is usually fabricated quasi-endlessly the metallized thread or filament is woven/non-woven in the ribbon as well and contacts the fabric of the ribbon, which is conveyed in the ribbon conveying table in the conveying direction, in the non-woven-in section. Therefore, the metallized thread or filament needs to be separated from the fabric in order to perform the cutting action, because the fabric of the ribbon should not be contacted or even damaged by the cutting assemblies. The separation of the metallized thread or filament from the fabric of the ribbon in the non-woven-in section is achieved by sliding spacers that slide between the metallized thread or filament and the fabric and thereby separate them the further the more the sliding spacers slide under the metallized thread or filament. At the edges the metallized thread or filament is fixed to the ribbon, wherein the sliding spacers slide under the metallized thread or filament anywhere between the edges, preferably close to the edges.

A particular advantage in the solution according to an aspect of the invention is that the non-woven-in section of the metallized thread or filament is severed from the ribbon only leaving a very short loose end of the metallized thread or filament behind at the edge of the woven section. As the metallized thread or filament remaining in the fabric in the woven section is to communicate via radio frequency, it is very important to not leave a long loose end behind since an undefined loose end of the metallized thread or filament disturbs the radio frequency signal.

Advantageous embodiments and further developments emerge from the description with reference to the figures.

According to some embodiments of the cutting device according to the invention, the sliding spacers have a distal end portion, which contacts the fabric when conveying the textile ribbon, and an elongated body extending from the distal end portion in a direction that is basically perpendicular to the conveying direction of the ribbon.

According to some further developments of the cutting device according to the invention, the elongated body includes an upper surface, which faces away from the fabric and extends from the fabric in an angle between 10° to 80°, preferably between 35° to 55° with regard to a conveying plane of the ribbon conveying table.

According to some embodiments of the cutting device according to the invention, along the conveying direction of the ribbon, the sliding spacers are positioned closer to each other than the cutting assemblies are positioned to each other.

According to some embodiments of the cutting device according to the invention, the cutting assemblies and/or the sliding spacers are kinematically connected via a tool connecting assembly, in particular a spindle or a shaft, such that the position of and/or the distance between the cutting assemblies and/or the sliding spacers are adjustable in an axis parallel to the conveying direction of the ribbon.

According to some embodiments of the cutting device according to the invention, the cutting assemblies and the sliding spacers have a first position, in which the ribbon is conveyable in the conveying direction, and a second position, wherein in the second position the metallized thread or filament is lifted away from the fabric by the sliding spacers, positioned between the metallized thread or filament and the fabric.

According to some further developments of the cutting device according to the invention, a travel from the first position to the second position of the cutting assemblies is substantially linear transverse to the conveying direction of the ribbon.

According to some further developments of the cutting device according to the invention, the cutting device further comprising a travel drive, in particular a pneumatic, hydraulic or electromechanical cylinder, which is coupled to the cutting assemblies and to the sliding spacers and configured to drive at least one of or each of the cutting assemblies and the sliding spacers along the travel by oscillating motion.

According to some embodiments of the cutting device according to the invention, the cutting device further comprising a sensor, in particular a capacitive, inductive, magnetic field or optical sensor, configured to sense reference positions of the metallized thread or filament in the fabric and a ribbon conveying drive configured to convey the ribbon in the conveying direction by an amount of travel which is based on the sensed reference positions of the metallized thread or filament in the fabric and a predetermined length of the woven/non-woven sections of the metallized thread or filament in the fabric.

According to some embodiments of the cutting device according to the invention, the cutting device further comprising at least two textile ribbon reels configured to take up the textile ribbon, wherein at least one of the at least two textile ribbon reels is positioned before and at least one of the at least two textile ribbon reels is positioned after the cutting assemblies and the sliding spacers in relation to the conveying direction of the ribbon.

According to some embodiments of the cutting device according to the invention, the cutting device further comprising a quality assurance device for assuring non-woven-in sections of the metallized thread or filament being completely severed from the fabric strap, the quality assurance device being positioned downstream the cutting assemblies and the sliding spacers in relation to the conveying direction of the ribbon.

According to some embodiments of the cutting device according to the invention, the cutting assemblies are configured as scissors each having a fixed scissor blade and a movable scissor blade, wherein the movable scissor blades are coupled to an actuator, in particular a pneumatic, hydraulic or electromechanical cylinder.

According to some embodiments of the cutting device according to the invention, the cutting device further comprising a supporting structure configured to mechanically support the cutting assemblies and the sliding spacers and mounted to the ribbon conveying table, preferably being pivotally mounted to the ribbon conveying table about an axis parallel to the conveying direction of the ribbon.

According to some aspects of the method according to the invention, during the step of conveying the cutting assemblies and the sliding spacers are in a first position, in which a distal end portion of the sliding spacers contacts the fabric.

According to some further aspects of the method according to the invention, the calculated amount of travel is based on a reference position of the metallized thread or filament in the fabric sensed by a sensor, in particular a capacitive, inductive, magnetic field or optical sensor, and a predetermined length of the woven/non-woven sections of the metallized thread or filament in the fabric.

According to some further aspects of the method according to the invention, in the step of traveling the sliding spacers with its distal end portion contacting the fabric slide basically linear transverse to the conveying direction of the stopped ribbon, wherein the non-woven section of the metallized thread or filament is lifted along an upper surface of the sliding spacers, wherein the upper surface faces away from the fabric and extends from the fabric in an angle between 10° to 80°, preferably between 35° to 55° with regard to a conveying plane of the ribbon conveying table.

According to some further aspects of the method according to the invention, the method further comprising the step of adjusting the position of and/or the distance between the cutting assemblies and/or the sliding spacers to a length of the non-woven section of the metallized thread or filament in the fabric via a tool connecting assembly, in particular a spindle or a shaft, in an axis parallel to the conveying direction of the ribbon.

According to some further aspects of the method according to the invention, the method further comprising the step of removing the severed metallized thread or filament from the ribbon conveying table where the cutting action is performed by an air stream generated by an air stream generator and streaming over the ribbon conveying table.

According to some implementations of the cutting device according to the third aspect of the invention, the fiber separators have a distal end portion, which is oriented and configured to contact the fabric strap, and an elongated body extending from the distal end portion in a direction that is basically perpendicular to the conveying direction of the fabric strap.

According to some implementations of the cutting device according to the third aspect of the invention, the elongated body includes an upper surface, which faces away from the fabric strap and extends from the fabric strap in an angle between 10° to 80°, preferably between 35° to 55° with regard to the strap conveying table.

According to some implementations of the cutting device according to the third aspect of the invention, the scissor assemblies and the fiber separators of two of the at least two tool holding structures are arranged in the respective tool holding structure such that the fiber separators are closer to each other than the scissor assemblies are to each other.

According to some implementations of the cutting device according to the third aspect of the invention, the tool holding structures are kinematically connected via a tool connection assembly, in particular a spindle or a shaft, such that the position of and/or the distance between the tool holding structures are adjustable in an axis parallel to the conveying direction of the fabric strap.

According to some implementations of the cutting device according to the third aspect of the invention, the tool holding structures have a first position, in which the fabric strap is conveyable in the conveying direction, and a second position, wherein in the second position the electrical conductive fiber is separated from the fabric strap by the fiber separators, positioned between the electrical conductive fiber and the fabric strap.

According to some implementations of the cutting device according to the third aspect of the invention, a travel from the first position to the second position of the tool holding structures is substantially linear transverse to the conveying direction of the fabric strap.

According to some implementations of the cutting device according to the third aspect of the invention, the device further comprises a travel drive, in particular a pneumatic, hydraulic or electromechanical cylinder, which is coupled to the tool holding structures and configured to drive at least one of or each of the tool holding structures along the travel by oscillating motion.

According to some implementations of the cutting device according to the third aspect of the invention, the device further comprises a sensor, in particular a capacitive, inductive, magnetic field or optical sensor, configured to sense reference positions of the electrical conductive fiber in the fabric strap and a strap conveying drive configured to convey the fabric strap in the conveying direction by an amount of travel which is based on the sensed reference positions of the electrical conductive fiber in the fabric strap and a predetermined length of the woven/non-woven sections of the electrical conductive fiber.

According to some implementations of the cutting device according to the third aspect of the invention, the device further comprises at least two fabric strap reels configured to take up the fabric strap, wherein at least one of the at least two fabric strap reels is positioned before and at least one of the at least two fabric strap reels is positioned after the at least two tool holding structures in relation to the conveying direction of the fabric strap.

According to some implementations of the cutting device according to the third aspect of the invention, the device further comprises a quality assurance device for assuring non-woven-in sections of the metallized thread or filament being completely severed from the fabric strap, the quality assurance device being positioned downstream the tool holding structures in relation to the conveying direction of the fabric strap.

According to some implementations of the cutting device according to the third aspect of the invention, the scissor assemblies are configured as scissors each having a fixed scissor blade and a movable scissor blade, wherein the movable scissor blades are coupled to an actuator, in particular a pneumatic, hydraulic or electromechanical cylinder.

According to some implementations of the cutting device according to the third aspect of the invention, the tool holding structures are configured to be pivotally in relation to the strap conveying table about an axis parallel to the conveying direction of the fabric strap.

According to some implementations of the method according to the fourth aspect of the invention, during the step of conveying the tool holding structures are in a first position, in which a distal end portion of the fiber separator contacts the fabric strap.

According to some implementations of the method according to the fourth aspect of the invention, the calculated amount of travel is based on a reference position of the thread in the fabric strap sensed by a sensor, in particular a capacitive, inductive, magnetic field or optical sensor, and a predetermined length of the woven/non-woven sections of the electrical conductive fiber in the fabric strap.

According to some implementations of the method according to the fourth aspect of the invention, in the step of traveling the fiber separators with its distal end contacting the textile slide basically linear transverse to the conveying direction of the stopped fabric strap, wherein the non-woven section of the electrical conductive fiber is lifted along an upper surface of the fiber separators, wherein the upper surface faces away from the fabric strap and extends from the fabric strap in an angle between 10° to 80°, preferably between 35° to 55° with regard to the strap conveying table.

According to some implementations of the method according to the fourth aspect of the invention, the method further comprises the step of adjusting the position of and/or the distance between the tool holding structures to a length of the non-woven section of the electrical conductive fiber in the fabric strap via a tool connecting assembly, in particular a spindle or a shaft, in an axis parallel to the conveying direction of the fabric strap.

According to some implementations of the method according to the fourth aspect of the invention, the method further comprises the step of removing the severed electrical conductive fiber from the strap conveying table where the severing action is performed by an air stream generated by an air stream generator and streaming over the strap conveying table.

The above embodiments and further developments can be combined with one another arbitrarily, as far as appropriate. Further possible configurations, developments and implementations of the invention are also combinations of features of the invention described above or below for the exemplary embodiments that are not explicitly cited. In particular, a person skilled in the art will also add individual aspects as improvements or additions to the respective basic form of the present invention.

BRIEF DESCRIPTION OF THE DRAWINGS

The present invention is explained more specifically below on the basis of the exemplary embodiments indicated in the schematic figures, in which.

DETAILED DESCRIPTION

Figure 1:
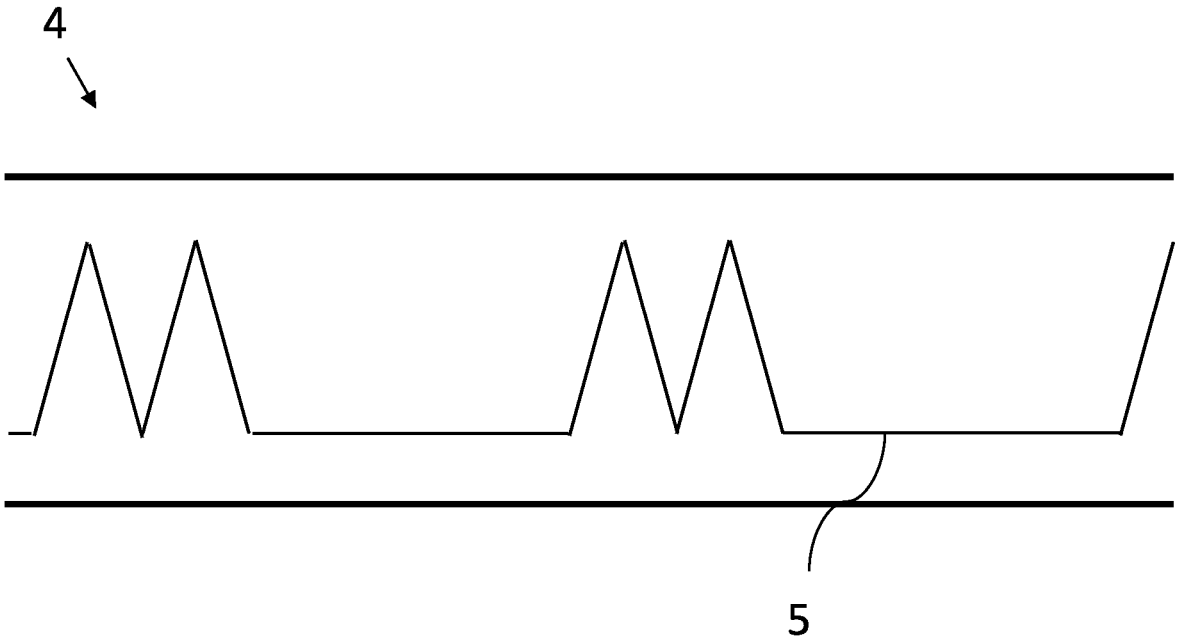
FIG. 1 shows a schematic illustration of a textile ribbon with a metallized thread or filament quasi-endlessly woven/non-woven in the fabric of the ribbon.

The accompanying figures are intended to convey a further understanding of the embodiments of the invention. They illustrate embodiments and are used in conjunction with the description to explain principles and concepts of the invention. Other embodiments and many of the cited advantages emerge in light of the drawings. The elements of the drawings are not necessarily shown to scale in relation to one another. Direction-indicating terminology such as for example "at the top", "at the bottom", "on the left", "on the right", "above", "below", "horizontally", "vertically", "at the front", "at the rear" and similar statements are merely used for explanatory purposes and do not serve to restrict the generality to specific configurations as shown in the figures.

In the figures of the drawing, elements, features and components that are the same, have the same function and have the same effect are each provided with the same reference signs—unless explained otherwise.

A ribbon conveying table may also be a strap conveying table in the meaning of the present invention.

A cutting assembly may also be a scissor assembly in the meaning of the present invention.

A sliding spacer may also be a fiber separator in the meaning of the present invention.

A textile ribbon may also be a fabric strap or any textile that is at least double in length in relation to its width in the meaning of the present invention.

A metallized thread or filament may also be an electrical conductive fiber or any yarn, thread or filament that is able to communicate via radio frequency in the meaning of the present invention.

A supporting structure may also be a tool holding structure or any structure that is configured to have at least a cutting assembly and a sliding spacer in the meaning of the present invention.

A ribbon conveying drive may also be strap conveying drive in the meaning of the present invention.

Figure 2:
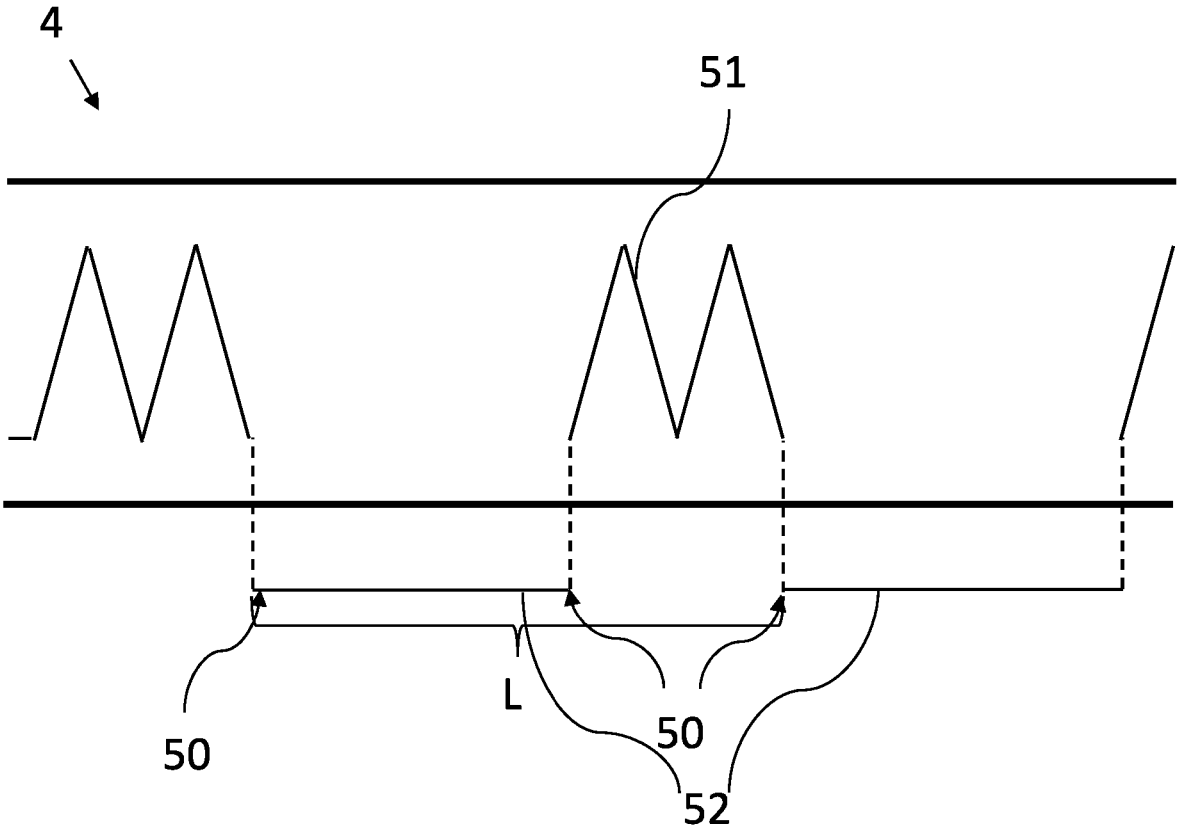
FIG. 2 shows a schematic illustration of a textile ribbon of FIG. 1 with severed non-woven-in sections of the metallized thread or filament.

FIG. 1 and FIG. 2 show a schematic illustration of a textile ribbon 4 with a metallized thread or filament 5 quasi-endlessly woven/non-woven in the fabric of the ribbon 4.

The textile ribbon 4 is produced quasi-endlessly. Also the metallized thread or filament 5 is produced and woven quasi-endlessly in the fabric of the ribbon 4 such that the metallized thread or filament 5 is an antenna or at least has the properties and functionalities of an antenna.

In particular, FIG. 2 shows a textile ribbon 4 with severed non-woven-in sections 52 of the metallized thread or filament 5. The non-woven-in sections 52 are cut at their edges 50, where the woven sections 51 of the metallized thread or filament 5 start/end. The woven sections 51 the metallized thread or filament 5 are woven in any pattern, preferably in serpentines, in the textile ribbon 4. For example, the metallized thread or filament 5 is woven in the textile ribbon 4 such that the non-woven-in sections 52 and the woven sections 51 alternate in a predetermined length L along the quasi-endlessly ribbon 4, wherein the predetermined length L is the length between an edge 50 of the beginning non-woven-in section 52 and an edge 50 of an ending woven section 51 in a longitudinal direction of the quasi-endlessly ribbon 4 as defined in FIG. 2. Thus, the predetermined length L includes the length of the woven section 51 and the non-woven-in section 52 in the longitudinal direction of the quasi-endlessly ribbon 4, the predetermined length L being constant at the textile ribbon 4 according to this embodiment.

Figure 3:
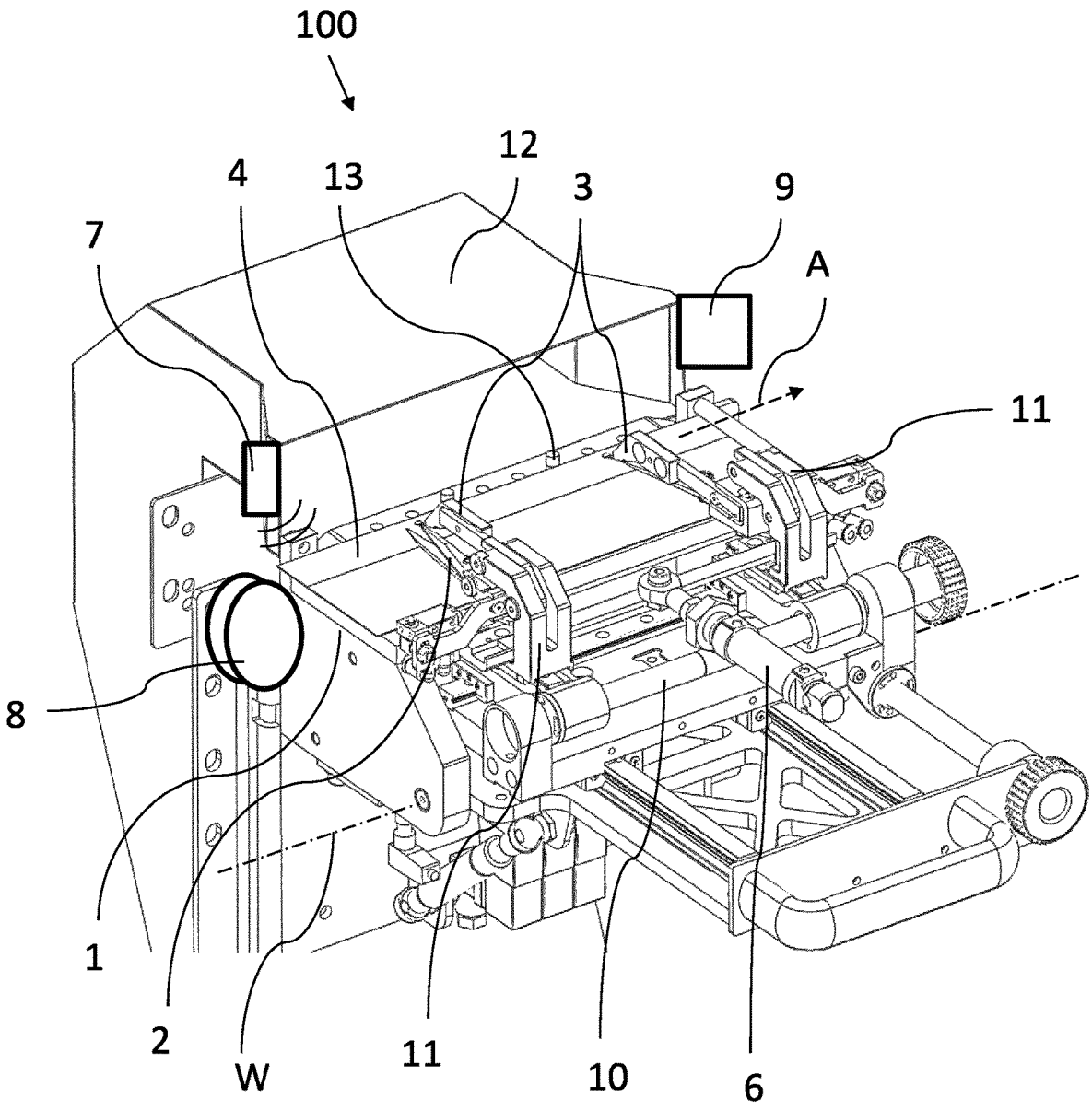
FIG. 3 shows an isometric illustration of a cutting device for severing non-woven-in sections of threads or filaments woven in textile ribbons according to one embodiment of the invention.
Figure 4:
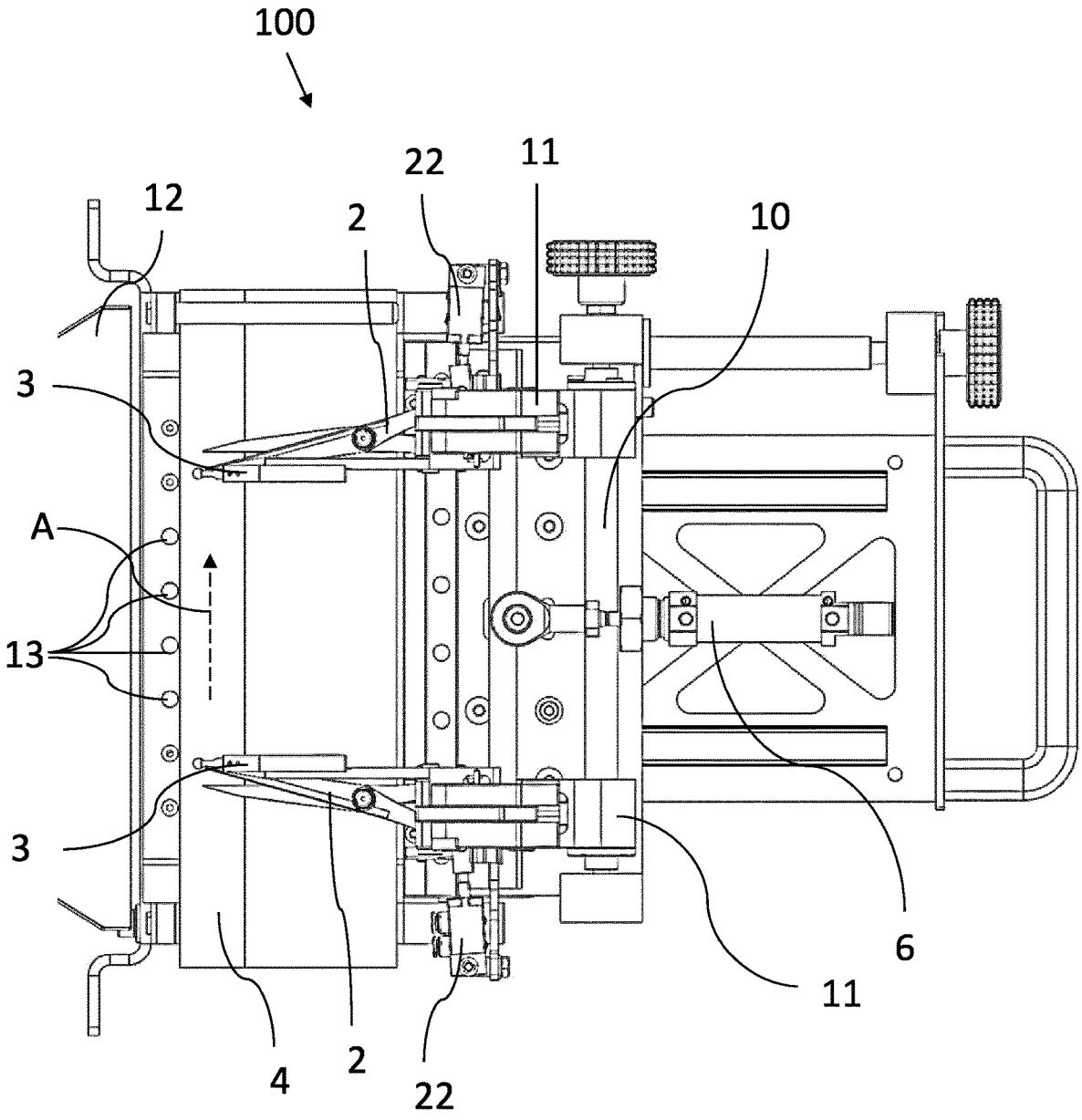
FIG. 4 shows a top view of a cutting device of FIG. 3 according to a further embodiment of the invention.
Figure 5:
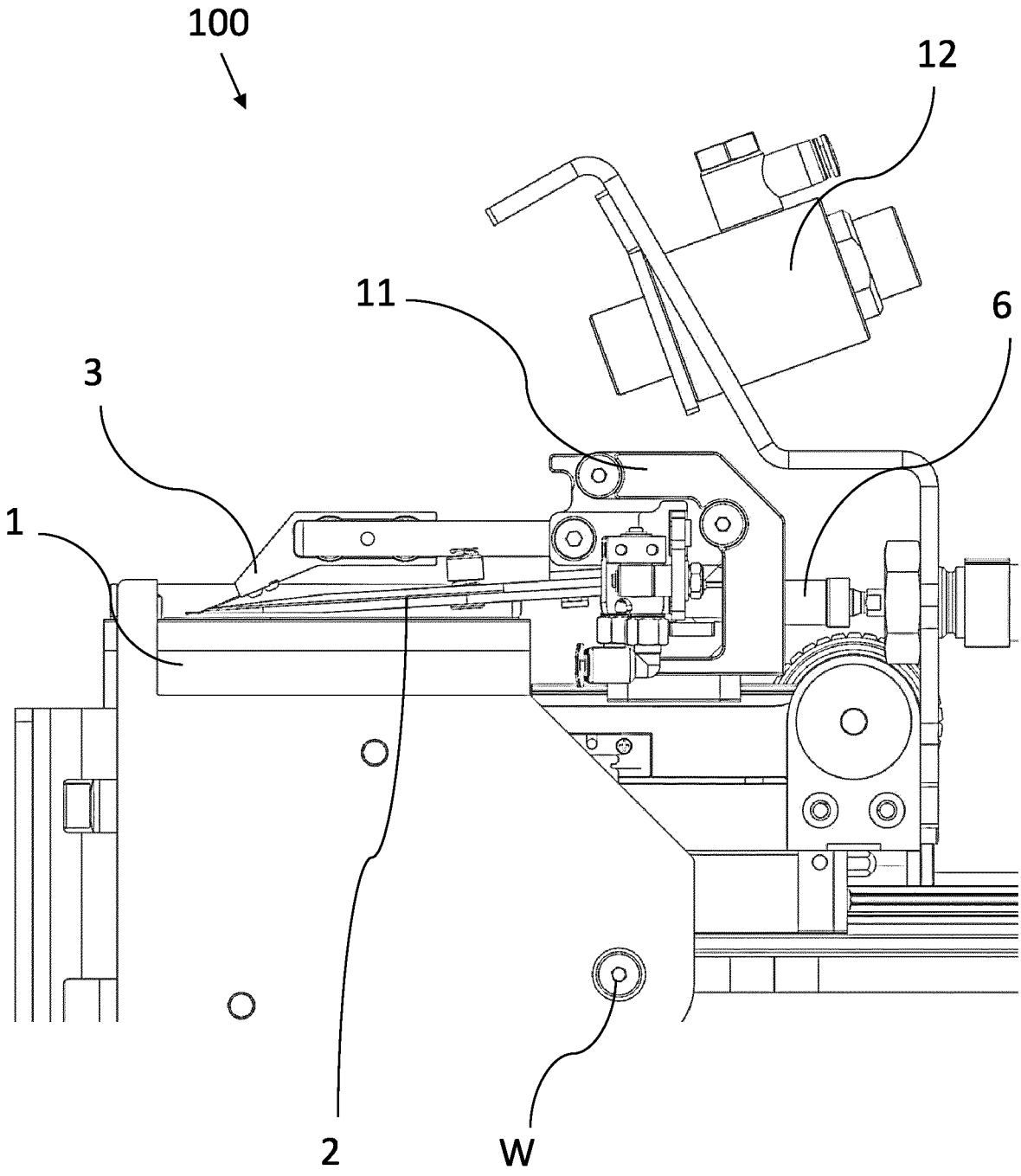
FIG. 5 shows a side view of a cutting device of FIG. 3 viewed in a conveying direction of the textile ribbon according to a further embodiment of the invention.

In FIGS. 3 to 5 a cutting device 100 according to embodiments of the invention is illustrated schematically. Components and features of the cutting device 100 that are the same in FIGS. 3 to 5 are only described once with regard to one of these Figures. Unless described otherwise, these components and features may be included and combined in each embodiment of the invention.

FIG. 3 shows an isometric illustration of a cutting device 100 for severing non-woven-in sections 52 of threads or filaments 5 woven in textile ribbons 4 according to one embodiment of the invention.

The cutting device 100 comprises a ribbon conveying table 1, at least two cutting assemblies 2 and at least two sliding spacers 3.

The ribbon conveying table 1 is configured to convey a textile ribbon 4 having a metallized thread or filament 5 quasi-endlessly woven/non-woven in the fabric of the ribbon 4, in particular the ribbon 4 of FIGS. 1 and 2. For conveying the textile ribbon 4 the ribbon conveying table 1 may have a ribbon conveying drive configured to convey the ribbon 4 in the conveying direction A. The ribbon conveying drive may be configured as an electrical, fluidical or combustion engine driving the ribbon 4 by rotating or linear drive means, in particular configured as a conveyor belt system with a plane belt driven between at least two cylindrical rolls. Furthermore, the ribbon conveying table 1 may have a basis standing on a floor and supporting at least some of the components of the ribbon conveying table 1.

The at least two cutting assemblies 2 are spaced apart from one another along the conveying direction A of the textile ribbon 4, the at least two cutting assemblies 2 being configured to simultaneously perform a cutting action for severing a non-woven-in section 52 of the metallized thread or filament 5 from the fabric of the ribbon 4. The cutting assemblies 2 can be kinematically connected via a tool connecting assembly 10, in particular a spindle or a shaft, such that the position of and/or the distance between the cutting assemblies 2 are adjustable in an axis parallel to the conveying direction A of the ribbon 4. The tool connecting assembly 10 is able to manually or automatically adjust the distance between the cutting assemblies 2 to the edges 50 of the metallized thread or filament 5, where the cutting assemblies 2 are to cut the metallized thread or filament 5. Alternatively or additional the tool connecting assembly 10 is configured to manually or automatically change the position of the cutting assemblies 2 in an axis parallel to the conveying direction A of the ribbon 4. Therefore, the embodiment according to FIG. 3 shows a divided threaded spindle, wherein each divisional part of the threaded spindle guides one of the at least two cutting assemblies 2 and wherein the threads of the two divisional parts of the threaded spindle are arranged in opposite direction such that by rotating the spindle the cutting assemblies 2 move closer together or remove from each other in the conveying direction A. For changing the position of the cutting assemblies 2 the spindle might be movably and fixedly supported in a shaft bearing, for example, that allows the spindle to be moved in its longitudinal direction in the conveying direction A.

The at least two sliding spacers 3 are spaced apart from one another along the conveying direction A of the textile ribbon 4, the at least two sliding spacers 3 each being connected to a respective one of the at least two cutting assemblies 2, contacting the surface of the ribbon 4 and being configured to slidingly move between the metallized thread or filament 5 and the fabric of the ribbon 4 at the edges 50 of the non-woven-in sections 52 to facilitate the cutting action of the at least two cutting assemblies 2. Similar to the cutting assemblies 2, the sliding spacers 3 can be kinematically connected via the tool connecting assembly 10, in particular a spindle or a shaft, such that the position of and/or the distance between the sliding spacers 3 are adjustable in an axis parallel to the conveying direction A of the ribbon 4. Optional sliding spacers 3 can be kinematically connected via a second tool connecting assembly being kinematically independent from the tool connecting assembly 10, which might connect the cutting assemblies 2. In FIG. 3, the cutting device 100 further comprises support structures 11 in which the cutting assemblies 2 and the sliding spacers 3 are supported, wherein each support structure 11 supports one cutting assembly of the at least two cutting assemblies 2 and one sliding spacer of the at least two sliding spacers 3. The support structures 11 can be directly or indirectly connected to the tool connecting assembly 10.

As illustrated in FIG. 3, the cutting device 100 may further comprise a sensor 7 configured to sense reference positions of the metallized thread or filament 5 in the fabric. The sensor 7 is in particular configured as a capacitive, inductive, magnetic field or optical sensor. The sensor 7 is preferably located upstream the cutting assemblies 2 and the sliding spacers 3 in relation to the conveying direction A of the ribbon 4. The sensor 7 might be designed to sense a specific point in the structure of the metallized thread or filament 5. The specific point in the structure of the metallized thread or filament 5 could be a starting point to calculate an amount of travel that is needed to travel the textile ribbon 4 in the conveying direction A until the ribbon 4 is stopped in a position relative to the cutting assemblies 2 and the sliding spacers 3 in the conveying direction A, in which the non-woven-in section 52 can be severed from the fabric of the ribbon 4.

Furthermore, the cutting device 100 may comprise a ribbon conveying drive configured to convey the ribbon 4 in the conveying direction A by the amount of travel which is based on the sensed reference positions of the metallized thread or filament 5 in the fabric and the predetermined length L of the woven/non-woven sections of the metallized thread or filament 5 in the fabric of the ribbon 4. The predetermined length L can be defined as described in the embodiment of FIG. 2, as the length of the non-woven-in section 52, as the length of the woven section 51 only or any other length that is characteristic for the textile ribbon 4 to position the edges 50 of the sections 51, 52 of the metallized thread or filament 5 in the above-described relation to the cutting assemblies 2 and the sliding spacers 3 in the conveying direction A.

The cutting device 100 may further comprise at least two textile ribbon reels 8 configured to take up the textile ribbon 4, wherein at least one of the at least two textile ribbon reels 8 is positioned before and at least one of the at least two textile ribbon reels 8 is positioned after the cutting assemblies 2 and the sliding spacers 3 in relation to the conveying direction A of the ribbon 4. The textile ribbon reels 8 can be configured as cardboard sleeves, spools or cylinder like forms. They might be pivotally mounted to the ribbon conveying table 1, wherein the rotation axis of the ribbon reels 8 is perpendicular to the conveying direction A.

Optional the cutting device 100 may comprise a quality assurance device 9 for assuring non-woven-in sections 52 of the metallized thread or filament 5 being completely severed from the fabric, the quality assurance device 9 being positioned downstream the cutting assemblies 2 and the sliding spacers 3 in relation to the conveying direction A of the ribbon 4. The quality assurance device 9 can be configured to visually supervise the surface of the textile ribbon 4 for defects of the ribbon 4 after the cutting action. Defects could be that the nonwoven in section 52 of the metallized thread or filament 5 has not been severed from the ribbon 4 and is still attached to the ribbon 4 or that the woven section 51 of the metallized thread or filament 5 is incorrect.

Furthermore, the cutting device 100 may have an air stream generator 12 configured to generate an air stream streaming over the ribbon conveying table 1. Therefore, the air stream generator 12 can be figured as an extraction system, as illustrated in FIG. 3, and arranged next to the ribbon conveying table 1 in view of the conveying direction A and opposite to the cutting assemblies 2 and the sliding spacers 3 with regard to the textile ribbon 4.

FIG. 4 shows a top view of a cutting device 100 of FIG. 3 according to a further embodiment of the invention.

According to the illustration of FIG. 4, along the conveying direction A of the ribbon 4, the sliding spacers 3 might be positioned closer to each other than the cutting assemblies 2 might be positioned to each other. Thereby, the distance in the conveying direction A between the two illustrated cutting assemblies 2 has a maximum amount being the length of the non-woven-in section 52. Furthermore, the cutting assemblies 2 and the sliding spacers 3 can be arranged parallel to each other and transverse to the conveying direction A of the ribbon 4.

The cutting assemblies 2 and the sliding spacers 3 might have a first position, in which the ribbon 4 is conveyable in the conveying direction A. In this first position, when the ribbon 4 is conveyed in the conveying direction A, the sliding spacers 3 contact the fabric of the ribbon 4 in a line of the ribbon 4 that is lateral displaced, in particular about 2 mm displaced, from the metallized thread or filament 5, which alignment basically corresponds to the conveying direction A in the non-woven-in section 52, with regard to the conveying direction A.

The cutting assemblies 2 and the sliding spacers 3 might further have a second position, in which the cutting action is performed by the cutting assemblies 2. Preferably, the sliding spacers 3 can contact the fabric of the ribbon 4 also in the second position, but are not limited thereto and can be positioned lateral to the ribbon 4 not contacting the fabric of the ribbon 4 as well. In this second position, the ribbon 4 is stopped and the sliding spacers 3 are positioned between the metallized thread or filament 5 in the non-woven-in section 52 and the fabric of the ribbon 4, wherein the metallized thread or filament is displaced vertical from the ribbon 4 such that to be cut by the cutting assemblies 2 without the cutting assemblies 2 contacting the fabric of the ribbon 4.

A travel from the first position to the second position of the cutting assemblies 2 and/or the sliding spacers 3 is substantially linear transverse to the conveying direction A of the ribbon 4. Therefore the cutting device 100 may have a travel drive 6, in particular a pneumatic, hydraulic or electromechanical cylinder, which is coupled to the cutting assemblies 2 and configured to drive at least one of or each of the cutting assemblies 2 along the travel by oscillating motion. Optional or additional the travel drive 6 can be coupled to the sliding spacers 3 and configured to drive at least one of or each of the sliding spacers 3 along the travel by oscillating motion. Furthermore, a plurality of travel drives 6 can be provided to travel each or groups of the cutting assemblies 2 and on the sliding spacers 3 kinematically and/or timely independently from one another.

The cutting device 100 might further comprise pins 13, which are configured to guide the ribbon 4 on the ribbon conveying table 1. the plurality of pins 13, shown in FIG. 4, are detachably connected to the ribbon conveying table 1, wherein the pins 13 are configured to be inserted into respective slots positioned in series along the conveying direction A. In particular, the pins 13 are inserted in those slots being upstream and/or downstream of the cutting assemblies 2 and the sliding spacers 3 in the conveying direction a such that the cutting assemblies 2 and the sliding spacers 3 cannot collide with the pins 13 when the second position of the cutting assemblies 2 and the sliding spacers 3 cause them to be positioned besides the ribbon 4.

FIG. 5 shows a side view of a cutting device 100 of FIG. 3 viewed in a conveying direction A of the textile ribbon 4 according to a further embodiment of the invention.

The travel drive 6 might also be coupled to the supporting structure 11 for traveling the supporting structures 11 supporting the cutting assemblies 2 and the sliding spacers 3 between the first position and the second position.

According to the embodiment of FIG. 5, the air stream generator 12 is configured as a nozzle arranged above the cutting assemblies 2 and the sliding spacers 3, wherein the head of the nozzle 12 is designed and oriented to generate an airflow streaming over the ribbon conveying table 1 to blow away the section of the metallized thread or filament 5 severed in the cutting action.

Moreover, the supporting structure 11 can be configured to mechanically support the cutting assemblies 2 and the sliding spacers 3 and mounted to the ribbon conveying table 1, preferably being pivotally mounted to the ribbon conveying table 1 about an axis W parallel to the conveying direction A of the ribbon 4. The supporting structures 11 can be arranged in an arrangement, for example, in a section of the ribbon conveying table 1 such that this section is pivotal to the basis of the ribbon conveying table 1 about the pivot axis W. The pivot axis W may be designed as a pivotal joint pivotally connecting the section of the ribbon conveying table 1, which includes at least the supporting structures 11 with the cutting assemblies 2 and the sliding spacers 3 and the travel drive 6, and the basis of the ribbon conveying table 1. Pivoting the cutting assemblies 2 and the sliding spacers 3 about the pivot axis W is beneficial for applying the textile ribbon 4 since the cutting assemblies and the sliding spacers 3 are lifted from a conveying plane of the ribbon conveying table 1. Furthermore, operations, such as maintenance or reparation, at the cutting assemblies 2 or the sliding spacers 3 are easier to perform when the cutting assemblies 2 and the sliding spacers 3 are in an upright position.

Figure 6:
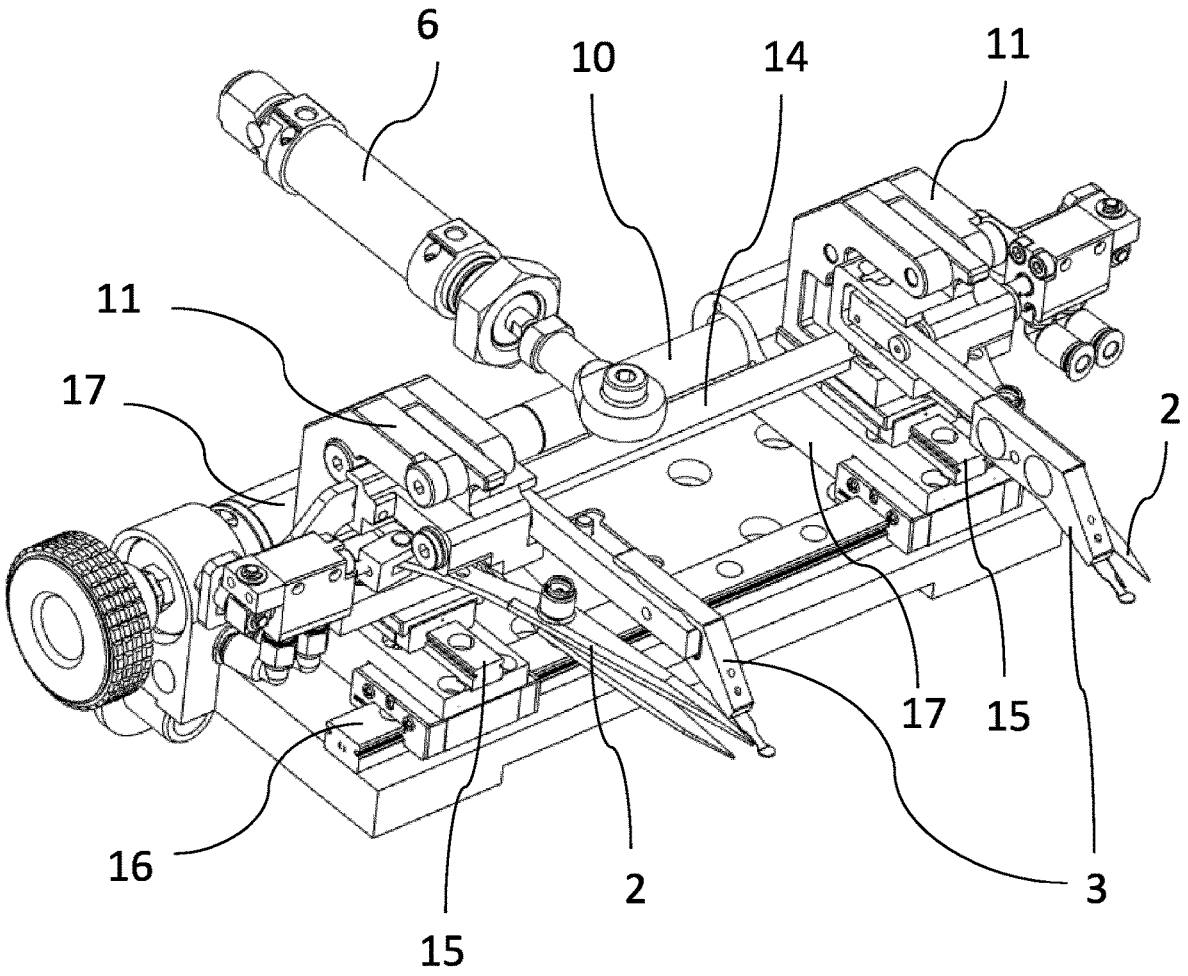
FIG. 6 shows a detail extract of an arrangement of cutting assemblies and sliding spacers on a section of the ribbon conveying table according to a further embodiment of the invention. The section of the ribbon conveying table 1, illustrated in FIG. 6, may be pivotally mounted to a basis of the ribbon conveying table 1 standing on a floor.

FIG. 6 shows a detail extract of the arrangement of cutting assemblies 2 and sliding spacers 3 on a section of the ribbon conveying table 1 with regard to FIG. 5 according to a further embodiment of the invention.

The arrangement may comprise a travel drive 6, a tool connecting assembly 10, two supporting structures 11 each having a cutting assembly 2 and a sliding spacer 3, a connecting bar 14, first and second guide rails 15, 16 and sliding bodies 17. The first guide rail 16 and the tool connecting assembly 10, in particular a divided spindle, are arranged parallel to one other and connected to a plate which might be pivotally mounted to the basis of the ribbon conveying table 1 about the people axis W. The sliding bodies 17 are connected to the tool connecting assembly 10 and guided in the first guide rail 16. On the sliding value the second guide rail 15 is provided and arranged perpendicular to the tool connecting assembly 10 and the first guide rail 16. With the second guide rail 15 the supporting structure 11 is guided. The two supporting structures 11 are slidingly connected via the connecting bar 14, the connecting bar 14 being parallel to the tool connecting assembly 10 and the first guide rail 16. The connecting bar 14 is configured to allow sliding of the two supporting structures 11 along the first guide rail 16, wherein the two supporting structures 11 are driven by the tool connecting assembly 10. Independent of the movement along the first guide rail 16, the travel drive 6 drives the supporting structures 11 along the second guide rails 15, wherein the travel drive 6 might further be fixed to the plate or a housing of the section of the ribbon conveying table. The first and the second guide rails 15, 16 can be configured as carriage guidance systems, for example, made of metals, light metals, plastics or combinations thereof.

Figure 7:
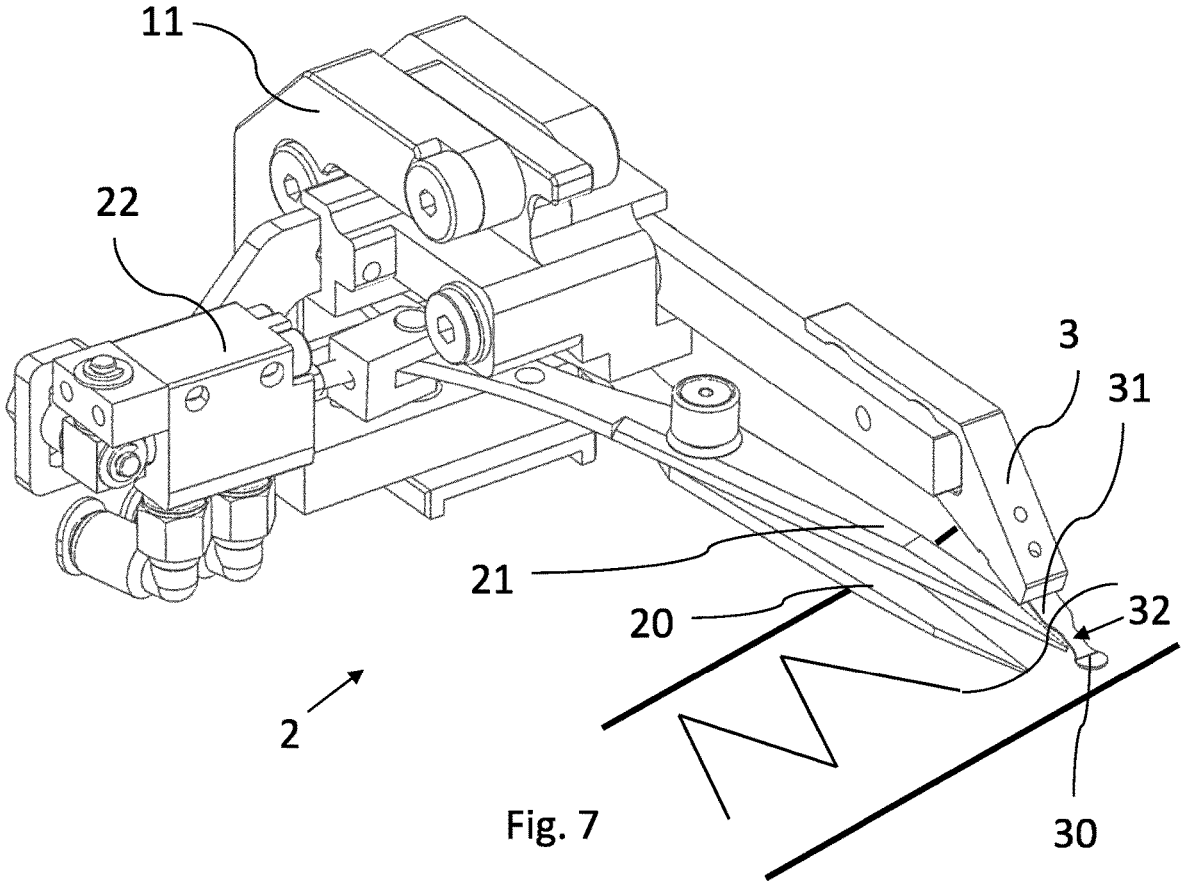
FIG. 7 shows a schematic illustration of a supporting structure having a cutting assembly and a sliding spacer according to a further embodiment of the invention.
Figure 8:
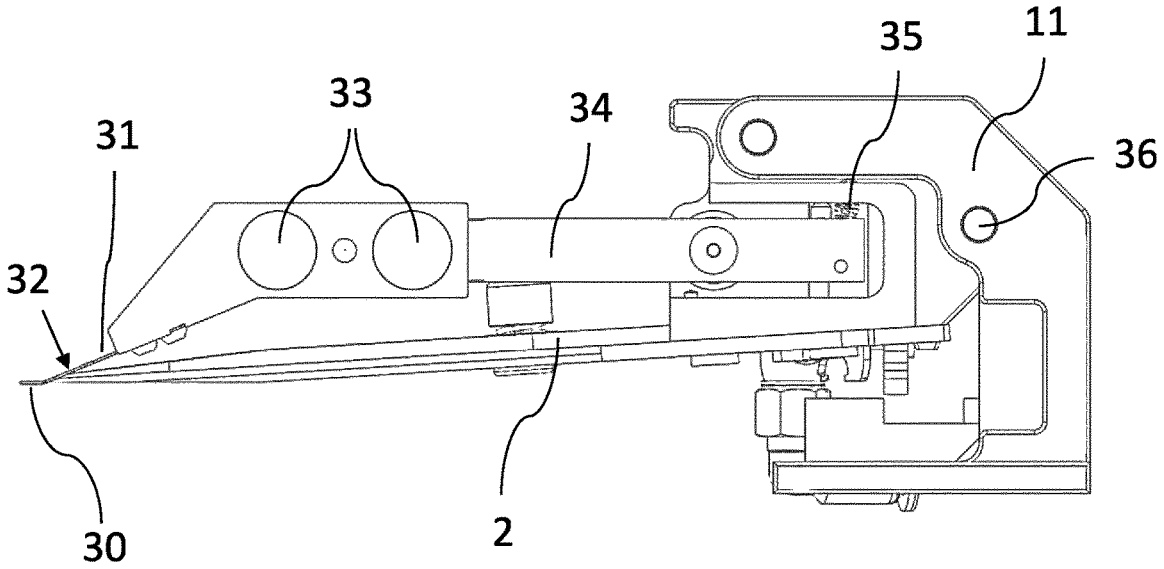
FIG. 8 shows a schematic side view of a supporting structure of FIG. 6 according to a further embodiment of the invention.

FIG. 7 and FIG. 8 show a schematic illustration of a supporting structure 11 having a cutting assembly 2 and a sliding spacer 3 according to a further embodiment of the invention.

The sliding spacer 3 may have a distal end portion 30, which contacts the fabric when conveying the textile ribbon 4. The edges of the sliding spacer 3, in particular the distal end portion 30, can provide a radius lower than 1 mm.

The sliding spacers 3 may further have an elongated body 31 extending from the distal end portion 30 in a direction that is basically perpendicular to the conveying direction A of the ribbon 4. Thereby the elongated body 31 includes an upper surface 32, which faces away from the fabric and extends from the fabric in an angle between 10° to 80°, preferably between 35° to 55° with regard to a conveying plane of the ribbon conveying table 1. The distal end portion 30 and the elongated body 31 can be made of metal, light metal, plastics or combinations thereof. Additionally the distal end portion 30 and the elongated body 31 can be configured elastically.

The cutting assembly 2 can be configured as a scissor having a fixed scissor blade 20 and a movable scissor blade 21, wherein the movable scissor blade 21 is coupled to an actuator 22, in particular a pneumatic, hydraulic or electromechanical cylinder. The actuator 22 is supported by the supporting structure 11. The scissor blades 20, 21 might be arranged at 0.2-0.5 mm above the textile ribbon 4 when conveyed in the ribbon conveying table 1. Moreover, the scissor blades 20, 21 can be arranged parallel to the textile ribbon 4. Optional, the scissor blades 20, 21 can also be arranged in an angle, in particular 0 to 45°, about the longitudinal axis of the scissor relative to the textile ribbon 4 such that it is easier for the cutting assembly 2 to cut the lifted metallized thread or filament 5 when the lifted metallized thread or filament 5 extending basically diagonal in relation to the conveying plane of the ribbon conveying table 1.

Preferably, the fixed scissor blade 20 lies below the movable scissor blade 21, but is not limited to that configuration and can also lie above the movable scissor blade 21. As can be seen in FIG. 7, the movable scissor blade 21 may be closer to the sliding spacer 3 in an open position of the scissor than the fixed scissor blade 20. Alternatively, the fixed scissor blade 20 may be closer to the sliding spacer 3 in an open position of the scissor than the movable scissor blade 21. Each supporting structure 11 in the cutting device 100 supporting at least the cutting assembly 2, the sliding spacer 3 and the actuator 22 can have an individual configuration and does not necessarily have to be identical to other supporting structures 11. According to some embodiments of FIGS. 4 and 6, one of the two supporting structures 11 supporting at least the cutting assembly 2, the sliding spacer 3 and the actuator 22 is configured reversed in comparison to the other of the two supporting structures 11.

In particular, FIG. 7 shows the cutting assembly 2 and the sliding spacer 3 in the second position being ready to perform the cutting action to sever the metallized thread or filament 5 from the fabric of the ribbon 4. The metallized thread or filament 5 in the non-woven-in section 52 contacts the upper surface 32 of the sliding spacer 3, the sliding spacer 3 being positioned between the metallized thread or filament 5 and the fabric of the ribbon 4. As illustrated in FIG. 7, in the second position the metallized thread or filament 5 is lifted by the gradient angle of the elongated body 31 of the sliding spacer 3 relative to the ribbon 4.

Further, FIG. 8 shows a schematic side view of the supporting structure 11 of FIG. 7.

The sliding spacer 3 may further comprise a solenoid 33 and can be magnetically connected to an extension arm 34 by the solenoid 33, the extension arm 34 being pivotally fixed to the supporting structure 11 and having the respective counterpart of the solenoid 33 of the sliding spacer 3. Furthermore, a spring 35 is positioned at a proximal end of the extension arm 34 and supported in the supporting structure 11, wherein the spring 35 is configured to preload the sliding spacer 3 when the distal end portion 30 is in contact with the fabric of the ribbon 4.

For adjusting the distance of the cutting assembly 2 above the textile ribbon 4, the cutting assembly 2 and/or the sliding spacer 3 can be pivotable around the axis of a screw 36 in the supporting structure 11, the axis of the screw 36 being parallel to the conveying direction A of the ribbon 4. Therefore, the screw 36 is to be loosened and fixed again in the supporting structure 11.

Figure 9:
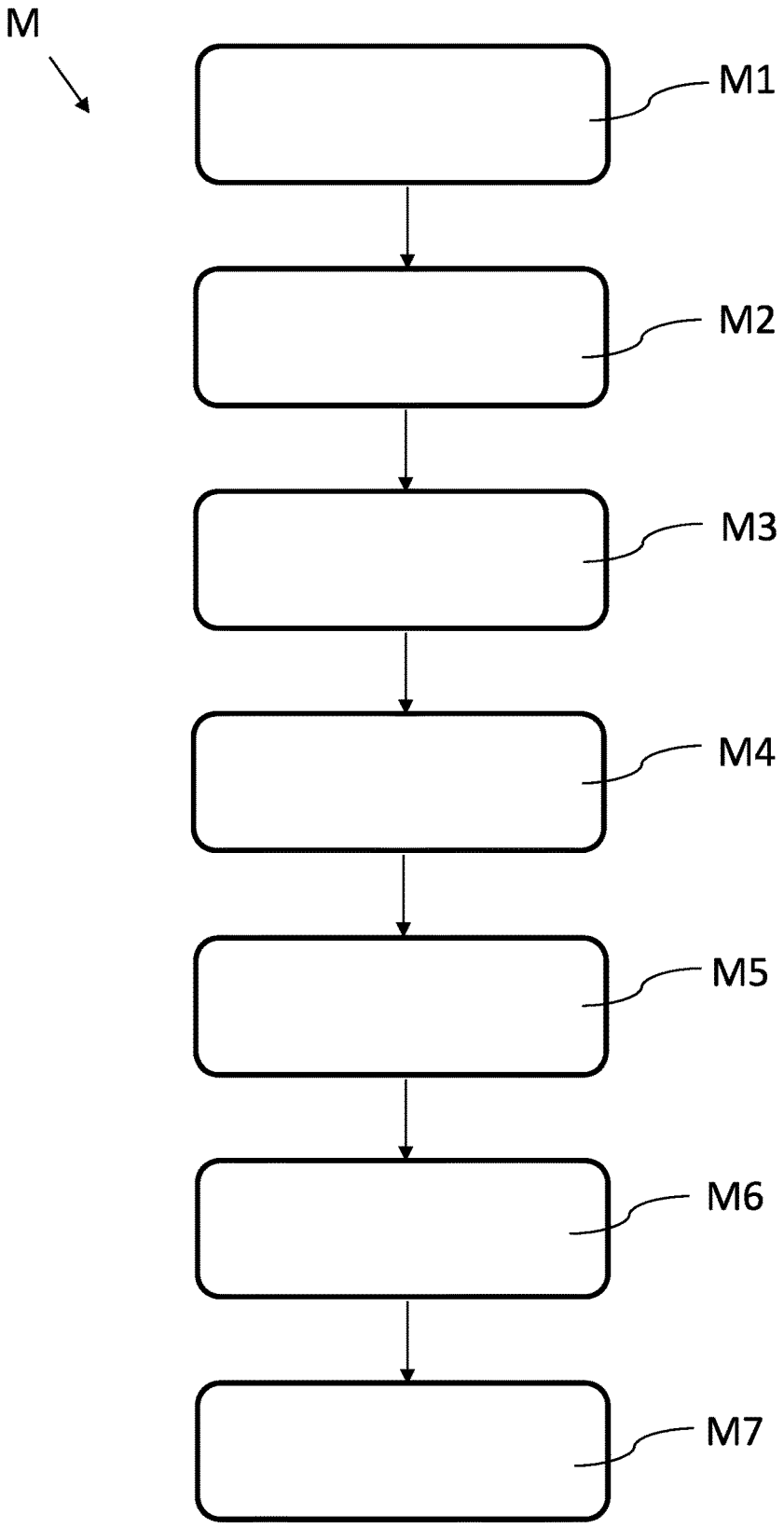
FIG. 9 shows a flow chart for a method for severing non-woven-in sections of threads or filaments woven in textile ribbons according to a further embodiment of the invention.

FIG. 9 shows a flow chart for a method M for severing non-woven-in sections 52 of threads or filaments 5 woven in textile ribbons 4 according to a further embodiment of the invention.

The method M comprises the step of providing M1 a cutting device 100, in particular a cutting device 100 according to any of the preceding claims, and a textile ribbon 4 having a metallized thread or filament 5 quasi-endlessly woven/non-woven in the fabric of the ribbon 4.

Furthermore, the method M comprises the step of conveying M2 the textile ribbon 4 in the ribbon conveying table 1 in the conveying direction A. During the step of conveying M2 the cutting assemblies 2 and the sliding spacers 3 might be in a first position, in which a distal end portion 30 of the sliding spacers 3 contacts the fabric. Thereby, the distal end portion 30 may slide over the fabric of the textile ribbon 4 and the metallized thread or filament 5 woven in the fabric of the textile ribbon in the woven sections 51 without damaging the metallized thread or filament 5 or the textile ribbon 4. In case of a force applying on the sliding spacer 3, in particular on the distal end portion 30 or the elongated body 31, the force being above a defined threshold for a holding force of the solenoid 33, the sliding spacer 3 would be disconnect from the extension arm 34 at the solenoid 33.

The method M further comprises the step of stopping M3 the ribbon 4 after conveying the ribbon 4 a calculated amount of travel. The calculated amount of travel may be based on a reference position of the metallized thread or filament 5 in the fabric sensed by a sensor 7 and a predetermined length L of the woven/non-woven-in sections 51, 52 of the metallized thread or filament 5 in the fabric. The sensor 7 is in particular configured as a capacitive, inductive, magnetic field or optical sensor. The sensor 7 could sense the reference position by being triggered to a characteristic point of the metallized thread or filament 5 which passes the sensor 7 such as the edge 50 of the non-woven-in sections 52 or a specific inductively marked point of the ribbon 4, for example marked by a specific metallized piece woven in the fabric of the ribbon 4 besides the metallized thread or filament 5 that triggers the sensor 7.

Moreover, the method M comprises the step of traveling M4 the cutting assemblies 2 and the sliding spacers 3 from the first position to a second position, wherein the sliding spacers 3 slide between the metallized thread or filament 5 and the fabric of the ribbon 4 at the edges 50 of the non-woven-in section 52 causing the metallized thread or filament 5 to lift away from the fabric. In the step of traveling M4 the sliding spacers 3 with its distal end portion 30 contacting the fabric may slide basically linear transverse to the conveying direction A of the stopped ribbon 4, wherein the non-woven section 52 of the metallized thread or filament 5 can be lifted along an upper surface 32 of the sliding spacers 3, wherein the upper surface 32 faces away from the fabric and extends from the fabric in an angle between 10° to 80°, preferably between 35° to 55° with regard to a conveying plane of the ribbon conveying table 1.

Further, the method M comprises the step of simultaneously performing M5 a cutting action for severing a non-woven-in section 52 of the metallized thread or filament 5 from the fabric of the ribbon 4 at the edges 50 of the non-woven-in section 52. The cutting action may be initiated by a control unit which can be electronically coupled to at least some components of the cutting device 100, in particular the travel drive 6, the sensor 7, the ribbon conveying drive and the actuators 22. The cutting action may be performed in the second position of the cutting assemblies 2 and the sliding spacers 3. For example, the actuators 22 simultaneously move the movable scissor blades 21 while the metallized thread or filament 5 is lifted by the sliding spacers 3 and a portion of the metallized thread or filament extending between the sliding spacer 3 and the edge 50 is arranged inside the fixed and the movable scissor blade 20, 21, thereby cutting the metallized thread or filament 5 at the edges 50 of the non-woven-in section 52.

The method M may further comprise the step of adjusting M6 the distance between the cutting assemblies 2 to a length of the non-woven section 52 of the metallized thread or filament 5 in the fabric via a tool connecting assembly 10, in particular a spindle or a shaft, in an axis parallel to the conveying direction A of the ribbon 4. Additionally or optional, the step of adjusting M6 may also include adjusting M6 the distance between the sliding spacers 3 to a length of the non-woven section 52 of the metallized thread or filament 5 in the fabric via a tool connecting assembly 10, in particular a spindle or a shaft, in an axis parallel to the conveying direction A of the ribbon 4.

Further, optional or additionally, step of adjusting M6 may include adjusting M6 the position of the cutting assemblies 2 to a position of the edges 50 of the non-woven section 52 of the metallized thread or filament 5 in the fabric via a tool connecting assembly 10, in particular a spindle or a shaft, in an axis parallel to the conveying direction A of the ribbon 4.

Optional, the method M may further comprise the step of removing M7 the severed metallized thread or filament 5 from the ribbon conveying table 1 where the cutting action is performed by an air stream generated by an air stream generator 12 and streaming over the ribbon conveying table 1. The air stream can be generated constantly or time by the time, in particular every time after the cutting action had been performed.

In the detailed description above, various features have been combined in one or more examples in order to improve the rigorousness of the illustration. However, it should be clear in this case that the above description is of merely illustrative but in no way restrictive nature. It serves to cover all alternatives, modifications and equivalents of the various features and exemplary embodiments. Many other examples will be immediately and directly clear to a person skilled in the art on the basis of his knowledge in the art in consideration of the above description.

The exemplary embodiments have been chosen and described in order to be able to present the principles underlying the invention and their application possibilities in practice in the best possible way. As a result, those skilled in the art can optimally modify and utilize the invention and its various exemplary embodiments with regard to the intended purpose of use. In the claims and the description, the terms "including" and "having" are used as neutral linguistic concepts for the corresponding terms "comprising". Furthermore, use of the terms "a", "an" and "one" shall not in principle exclude the plurality of features and components described in this way.

While at least one exemplary embodiment of the present invention(s) is disclosed herein, it should be understood that modifications, substitutions and alternatives may be apparent to one of ordinary skill in the art and can be made without departing from the scope of this disclosure. This disclosure is intended to cover any adaptations or variations of the exemplary embodiment(s). In addition, in this disclosure, the terms "comprise" or "comprising" do not exclude other elements or steps, the terms "a" or "one" do not exclude a plural number, and the term "or" means either or both. Furthermore, characteristics or steps which have been described may also be used in combination with other characteristics or steps and in any order unless the disclosure or context suggests otherwise. This disclosure hereby incorporates by reference the complete disclosure of any patent or application from which it claims benefit or priority.

REFERENCE LIST

1 ribbon conveying table
2 cutting assemblies
3 sliding spacers
4 textile ribbon
5 metallized thread of filament
6 travel drive
7 sensor
8 textile ribbon reels
9 quality assurance device
10 tool connecting assembly
11 supporting structure
12 airstream generator
13 pin
14 connecting bar
15 first guide rail
16 second guide rail
17 sliding body
20 fixed scissor blade
21 movable scissor blade
22 actuator
30 distal end portion
31 elongated body
32 upper surface
33 magnet
34 extension arm
35 spring
36 screw
100 cutting device
A conveying direction
W pivot axis
M method
M1 method step
M2 method step
M3 method step
M4 method step
M5 method step
M6 method step
M7 method step

The invention claimed is:

1. A cutting device for severing non-woven-in sections of threads or filaments woven in textile ribbons, the cutting device comprising:

a ribbon conveying table configured to convey a textile ribbon having a metallized thread or filament quasi-endlessly woven/non-woven in the fabric of the ribbon;

at least two cutting assemblies-spaced apart from one another along the conveying direction (A) of the textile ribbon, the at least two cutting assemblies being configured to simultaneously perform a cutting action for severing a non-woven-in section of the metallized thread or filament from the fabric of the ribbon; and at least two sliding spacers spaced apart from one another along the conveying direction of the textile ribbon, the at least two sliding spacers each being connected to a respective one of the at least two cutting assemblies, contacting the surface of the ribbon and being configured to slidingly move between the metallized thread or filament and the fabric of the ribbon at the edges of the non-woven-in sections to facilitate the cutting action of the at least two cutting assemblies wherein the cutting assemblies and the sliding spacers have a first position, in which the ribbon is conveyable in the conveying direction (A), and a second position, wherein in the second position the metallized thread or filament is lifted away from the fabric by the sliding spacers, positioned between the metallized thread or filament and the fabric.

2. The cutting device according to claim 1, wherein the sliding spacers have a distal end portion, which contacts the fabric when conveying the textile ribbon, and an elongated body-extending from the distal end portion in a direction that is basically perpendicular to the conveying direction (A) of the ribbon.

3. The cutting device according to claim 2, wherein the elongated body includes an upper surface, which faces away from the fabric and extends from the fabric in an angle between 10° to 80°, preferably between 35° to 55° with regard to a conveying plane of the ribbon conveying table.

4. The cutting device according to claim 1, wherein, along the conveying direction (A) of the ribbon, the sliding spacers are positioned closer to each other than the cutting assemblies are positioned to each other.

5. The cutting device according to claim 1, wherein the cutting assemblies and/or the sliding spacers are kinematically connected via a tool connecting assembly, comprising a spindle or a shaft, such that the position of and/or the distance between the cutting assemblies and/or the sliding spacers are adjustable in an axis parallel to the conveying direction (A) of the ribbon.

6. The cutting device according to claim 1, wherein a travel from the first position to the second position of the cutting assemblies is substantially linear transverse to the conveying direction (A) of the ribbon.

7. The cutting device according to claim 6, further comprising:

a travel drive comprising, a pneumatic, hydraulic or electromechanical cylinder, which is coupled to the cutting assemblies and to the sliding spacers and configured to drive at least one of or each of the cutting assemblies and the sliding spacers along the travel by oscillating motion.

8. The cutting device according to claim 1, further comprising:

a capacitive, inductive, magnetic field or optical sensor, configured to sense reference positions of the metallized thread or filament in the fabric; and a ribbon conveying drive configured to convey the ribbon in the conveying direction (A) by an amount of travel which is based on the sensed reference positions of the metallized thread or filament in the fabric and a predetermined length of the woven/non-woven sections of the metallized thread or filament in the fabric.

9. The cutting device according to claim 1, further comprising:

at least two textile ribbon reels configured to take up the textile ribbon, wherein at least one of the at least two textile ribbon reels is positioned before and at least one of the at least two textile ribbon reels is positioned after the cutting assemblies and the sliding spacers in relation to the conveying direction (A) of the ribbon.

10. The cutting device according to claim 1, further comprising:

a quality assurance device for assuring non-woven-in sections of the metallized thread or filament being completely severed from the fabric of the ribbon, the quality assurance device being positioned downstream the cutting assemblies and the sliding spacers in relation to the conveying direction (A) of the ribbon.

11. The cutting device according to claim 1, wherein the cutting assemblies are configured as scissors each having a fixed scissor blade and a movable scissor blade, wherein the movable scissor blades are coupled to an actuator, comprising in a pneumatic, hydraulic or electromechanical cylinder.

12. The cutting device according to claim 1, further comprising:

a supporting structure configured to mechanically support the cutting assemblies and the sliding spacers and mounted to the ribbon conveying table, preferably being pivotally mounted to the ribbon conveying table about an axis parallel to the conveying direction of the ribbon.

13. A method for severing non-woven-in sections (52) of threads or filaments woven in textile ribbons, the method comprising the steps of:

providing a cutting device according to any of the preceding claims, and a textile ribbon having a metallized thread or filament quasi-endlessly woven/non-woven in the fabric of the ribbon;

conveying the textile ribbon in the ribbon conveying table in the conveying direction;

stopping the ribbon after conveying the ribbon a calculated amount of travel;

traveling the cutting assemblies and the sliding spacers from a first position to a second position, wherein the sliding spacers between the metallized thread or filament and the fabric of the ribbon at the edges of the non-woven-in section causing the metallized thread or filament to lift away from the fabric; and simultaneously performing a cutting action for severing a non-woven-in section of the metallized thread or filament from the fabric of the ribbon at the edges of the non-woven-in section.

14. The method according to claim 13, wherein during the step of conveying the cutting assemblies and the sliding spacers are in a first position, in which a distal end portion of the sliding spacers contacts the fabric.

15. The method according to claim 13, wherein the calculated amount of travel is based on a reference position of the metallized thread or filament in the fabric sensed by a capacitive, inductive, magnetic field or optical sensor, and a predetermined length of the woven/non-woven sections of the metallized thread or filament in the fabric.

16. The method according to claim 1, wherein in the step of traveling the sliding spacers with its distal end portion contacting the fabric slide basically linear transverse to the conveying direction of the stopped ribbon, wherein the non-woven section of the metallized thread or filament is lifted along an upper surface of the sliding spacers, wherein the upper surface faces away from the fabric and extends from the fabric in an angle between 10° to 80°, preferably between 35° to 55° with regard to a conveying plane of the ribbon conveying table.

17. The method according to claim 13, further comprising the step of adjusting the position of and/or the distance between the cutting assemblies and/or the sliding spacers to a length of the non-woven section of the metallized thread or filament in the fabric via a tool connecting assembly, comprising a spindle or a shaft, in an axis parallel to the conveying direction of the ribbon.

18. The method according to claim 13, further comprising the step of removing the severed metallized thread or filament from the ribbon conveying table where the cutting action is performed by an air stream generated by an air stream generator and streaming over the ribbon conveying table.

* * * * *